US012403519B2

(12) United States Patent
Li et al.

(10) Patent No.: US 12,403,519 B2
(45) Date of Patent: Sep. 2, 2025

(54) SPLITTING SPINNING APPARATUS

(71) Applicant: NINGBO UNIVERSITY, Zhejiang (CN)

(72) Inventors: Zixuan Li, Ningbo (CN); Xuedao Shu, Ningbo (CN); Junkun Leng, Ningbo (CN); Xiaomiao Niu, Ningbo (CN)

(73) Assignee: NINGBO UNIVERSITY, Ningbo (CN)

( * ) Notice: Subject to any disclaimer, the term of this patent is extended or adjusted under 35 U.S.C. 154(b) by 246 days.

(21) Appl. No.: 18/206,750

(22) Filed: Jun. 7, 2023

(65) Prior Publication Data

US 2024/0375168 A1 Nov. 14, 2024

(30) Foreign Application Priority Data

May 10, 2023 (CN) ..... 202310526169.X

(51) Int. Cl.
*B21D 22/14* (2006.01)

(52) U.S. Cl.
CPC ..... *B21D 22/14* (2013.01)

(58) Field of Classification Search
CPC ..... B21D 22/14; B21D 22/16; B21D 22/18
See application file for complete search history.

(56) References Cited

FOREIGN PATENT DOCUMENTS

CA 2329443 A1 * 6/2001 ..... B21D 22/16

* cited by examiner

*Primary Examiner* — Debra M Sullivan
(74) *Attorney, Agent, or Firm* — Oliff PLC

(57) ABSTRACT

Disclosed is a splitting spinning apparatus, including: a base, a turntable for supporting a blank, a rotating mechanism for driving the turntable, a mandrel disposed above the turntable, and a first drive mechanism for driving the mandrel to move along a vertical direction, a roller being provided at one side of the turntable, a second drive mechanism and a third drive mechanism being disposed on the base; the splitting spinning apparatus further includes a squeezing roll and a fourth drive mechanism; the turntable includes an inner plate, an outer plate, and a hold mechanism, the blank having a diameter greater than that of the inner plate and less than an outer diameter of the outer plate, an upper side of the inner plate being in flush with an upper side of the outer plate, an outer diameter of the squeezing roll being equal to the diameter of the inner plate.

8 Claims, 9 Drawing Sheets

SPLITTING SPINNING APPARATUS

FIELD

The disclosure pertains to the technical field of splitting spinning apparatuses, and more particularly relates to a splitting spinning apparatus.

BACKGROUND

Dual-cylinder structures have a wide array of applications, e.g., flame tubes for turbojet and turbofan engines. The dual-cylinder structure comprises a bottom plate, an inner cylinder, and an outer cylinder. Conventional splitting spinning apparatuses cannot work the outer cylinder. For example, a splitting spinning apparatus has been proposed in the *Study on Dividing Spinning Process of Cylindrical Parts With Bottom Flange* published in the journal "Aeronautical Manufacturing Technology," where the splitting spinning apparatus comprises a backing plate, a mandrel, and a roller; upon working, the mandrel compresses a blank tightly on the backing plate, then the roller moves along the radial direction of the blank to splitting spin the upper side of the blank, whereby an edge of the blank is bifurcated into a baseplate and a big-end-up trumpet flange; after the roller gets close to the mandrel, the roller moves upward to spin the trumpet flank, where the trumpet flange is deformed to form an inner cylinder fitted to the outer side of the mandrel. However, existing splitting spinning apparatuses cannot continue spinning the baseplate to work an outer cylinder.

SUMMARY

To address a drawback of conventional splitting spinning apparatuses which cannot work an outer cylinder, the disclosure provides a splitting spinning apparatus which can work an outer cylinder.

To achieve the objective above, the disclosure adopts a technical solution summarized below:

A splitting spinning apparatus, comprising a base, a turntable for supporting a blank, a rotating mechanism for driving the turntable, a mandrel disposed above the turntable, and a first drive mechanism for driving the mandrel to move along a vertical direction, a roller being provided at one side of the turntable, a second drive mechanism for driving the roller to move along a radial direction of the blank and a third drive mechanism for driving the roller to move along the vertical direction being disposed on the base; wherein the splitting spinning apparatus further comprises a squeezing roll disposed above the turntable and a fourth drive mechanism for driving the squeezing roll to move along the vertical direction, the squeezing roll and the mandrel being coaxially arranged; wherein the turntable comprises an inner plate rotatably connected to the base, an outer plate sleeved outside of the inner plate and slidable along an axial direction of the inner plate, and a hold mechanism for holding the outer plate in place, the blank having a diameter greater than a diameter of the inner plate and less than an outer diameter of the outer plate, an upper side of the inner plate being in flush with an upper side of the outer plate, an outer diameter of the squeezing roll being equal to the diameter of the inner plate.

With the above arrangement, the roller first splitting spins the blank to cause an edge of the blank to be bifurcated into a baseplate and a trumpet flange; then, the roller moves upward to spin the trumpet flange to form the inner cylinder; for continuously working the outer cylinder, the outer plate moves downward to expose the lower side of the baseplate to the air; after the squeezing roll compresses the baseplate tightly against the inner plate, the roller moves along the radial direction of the blank, and then the edge of the baseplate tilts upward under the action of the roller, such that after the roller gets close to the squeezing roll, the roller moves upward to cause the baseplate to be continuously deformed to form the outer cylinder fitted to the outer wall of the squeezing roll.

Furthermore, the roller comprises a first state and a second state; when the roller is in the first state, one end of the roller proximal to the turntable tilts downward for the roller to splitting spin the upper side of the blank to form an inner cylinder; when the roller is in the second state, one end of the roller proximal to the turntable tilts upward, such that the roller spins the baseplate to form an outer cylinder.

With the arrangement above, the disclosure eliminates the need of first processing the edge of the baseplate when working the outer cylinder; instead, the roller in the second state moves directly upward to spin the baseplate to form the outer cylinder, whereby the disclosure improves the efficiency of working the outer cylinder.

Furthermore, a lifting platform is disposed at one side of the turntable; the third drive mechanism is disposed on the base and connected to the lifting platform, an upper side of the lifting platform is slidably connected to a sliding seat; the second drive mechanism is disposed on the lifting platform and connected to the sliding seat; a roller carrier is provided at one side of the sliding seat proximal to the turntable, one end of the roller carrier proximal to the turntable being rotatably connected to the roller, the roller carrier being rotatably connected to the sliding seat, whereby state switching of the roller is enabled by turning the roller carrier; and the sliding seat is provided with a locking mechanism for locking the roller carrier.

The above arrangement facilitates switching the states of the roller, further enhancing production efficiency of the disclosure.

Furthermore, the roller carrier comprises a rotating seat rotatably connected to the sliding seat and a bracket securely connected to one side of the rotating seat proximal to the turntable; the roller is rotatably connected to one end of the bracket proximal to the turntable; and the locking mechanism comprises a retaining ring securely connected to the sliding seat and a locking bolt thread-fitted to the retaining ring, the rotating seat being rotatably connected inside the retaining ring, the locking bolt abutting against the rotating seat.

The arrangement above facilitates tightly locking the roller carrier.

Furthermore, a first limiting rod is securely connected to an upper side of the retaining ring, a second limiting rod is securely connected to a lower side of the retaining ring, and a rotating rod is securely connected to the rotating seat; wherein when the rotating rod abuts against the first limiting rod, the roller is disposed in the first state; when the rotating rod abuts against the second limiting rod, the roller is disposed in the second state.

With the arrangement above, positioning of the roller carrier is facilitated when the roller is switched between the states by turning the roller carrier.

Furthermore, a top plate is disposed above the base, the top plate being securely connected to the base via a connecting plate, and the first drive mechanism is configured as a first oil cylinder, the first oil cylinder comprising a first cylinder body securely connected to a lower side of the top plate, a first piston slidably connected inside the first cylinder body, a first piston rod securely connected to a lower side of the first piston, and a first oil pump connected to the first cylinder body, a lower end of the first piston rod being rotatably connected to the squeezing roll.

Furthermore, the fourth drive mechanism comprises a shell sleeved over the first cylinder body, and a first cavity surrounding the first cylinder body is formed between the shell and the first cylinder body; and the fourth drive mechanism further comprises a second piston slidingly connected inside the first cavity, a second piston rod securely connected to a lower side of the second piston, and a second oil pump in communication with the first cavity, a mounting plate being securely connected to a lower end of the second piston rod, the squeezing roll being rotatably connected to a lower side of the mounting plate.

Furthermore, a rotating plate is disposed between the mounting plate and the squeezing roll, the rotating plate and the mounting plate being both of an annular shape, the first piston rod passing through the rotating plate and the mounting plate, the rotating plate and the squeezing roll being detachably connected; a guide ring extending upward is securely connected to an inner side of the rotating plate; a limiting protrusion extending outward is securely connected to an upper side of the guide ring; an inner side of the mounting plate is disposed between the limiting protrusion and the rotating plate; a rolling bearing is disposed between the mounting plate and the guide ring; a thrust bearing is disposed between the limiting protrusion and the mounting plate; and the thrust bearing is further disposed between the mounting plate and the rotating plate.

The arrangement above increases rotating stability of the squeezing roll and also reduces resistance against rotation of the squeezing roll.

Furthermore, the rotating mechanism comprises an output seat rotatably connected to the base, the inner plate being disposed at an upper side of the output seat and securely connected to the output seat via a connecting post; wherein the rotating mechanism further comprises a driven wheel securely coupled to the output seat, an electric motor disposed a lower side of the base, and a driving wheel attached to the electric motor, the driving wheel being in transmission connection with the driven wheel via a belt, a radius of the driving wheel being smaller than a radius of the driven wheel.

The arrangement above amplifies the force outputted from the output seat.

Furthermore, an endplate is securely attached to an upper end of the squeezing roll, the endplate being detachably connected to the rotating plate; the first piston rod passes through the endplate and is in sealed connection with the endplate; an O-shaped ring is disposed between the first piston rod and the endplate; a first gas channel passing through upper and lower sides of the endplate is provided on the endplate, a lower end of the first gas channel extending till an inner side of the squeezing roll, the first gas channel being provided with a one-way valve facing the inner side of the squeezing roll; the hold mechanism comprises a slide bushing sleeved over the connecting post and a holding bolt in threaded connection with the slide bushing, the holding bolt abutting against the connecting post; a plurality of catching grooves are provided at an upper side of the inner plate; a second gas channel is provided inside the connecting post, an upper end of the second gas channel communicating with the catching grooves; a second cavity is provided at an inner side of the output seat, a third piston being slidably attached inside the second cavity, the third piston partitioning the second cavity into an upper chamber disposed at an upper side of the third piston and a lower chamber disposed at a lower side of the third piston, the upper chamber communicating with the second gas channel, the lower chamber communicating with the air; and the lower chamber is provided with a spring exerting an upward force against the third piston; a connecting rod is securely connected to an upper side of the third piston, and an upper end of the connecting rod abuts against the slide bushing.

With the above arrangement, after the inner cylinder is completely worked and the squeezing roll compresses the baseplate tightly against the inner plate, it is easy to pull the mandrel out of the inner cylinder; to work the outer cylinder, the outer plate moves downward to bring the third piston to move downward, where the third piston draws out the air in the catching grooves such that the catching grooves securely hold the blank; after the outer cylinder is completely worked, the first piston rod moves downward to increase the air pressure in the squeezing roll, whereby the squeezing roll is easily pulled out from the outer cylinder, which improves demolding efficiency of the disclosure.

DETAILED DESCRIPTION

Figure 1:
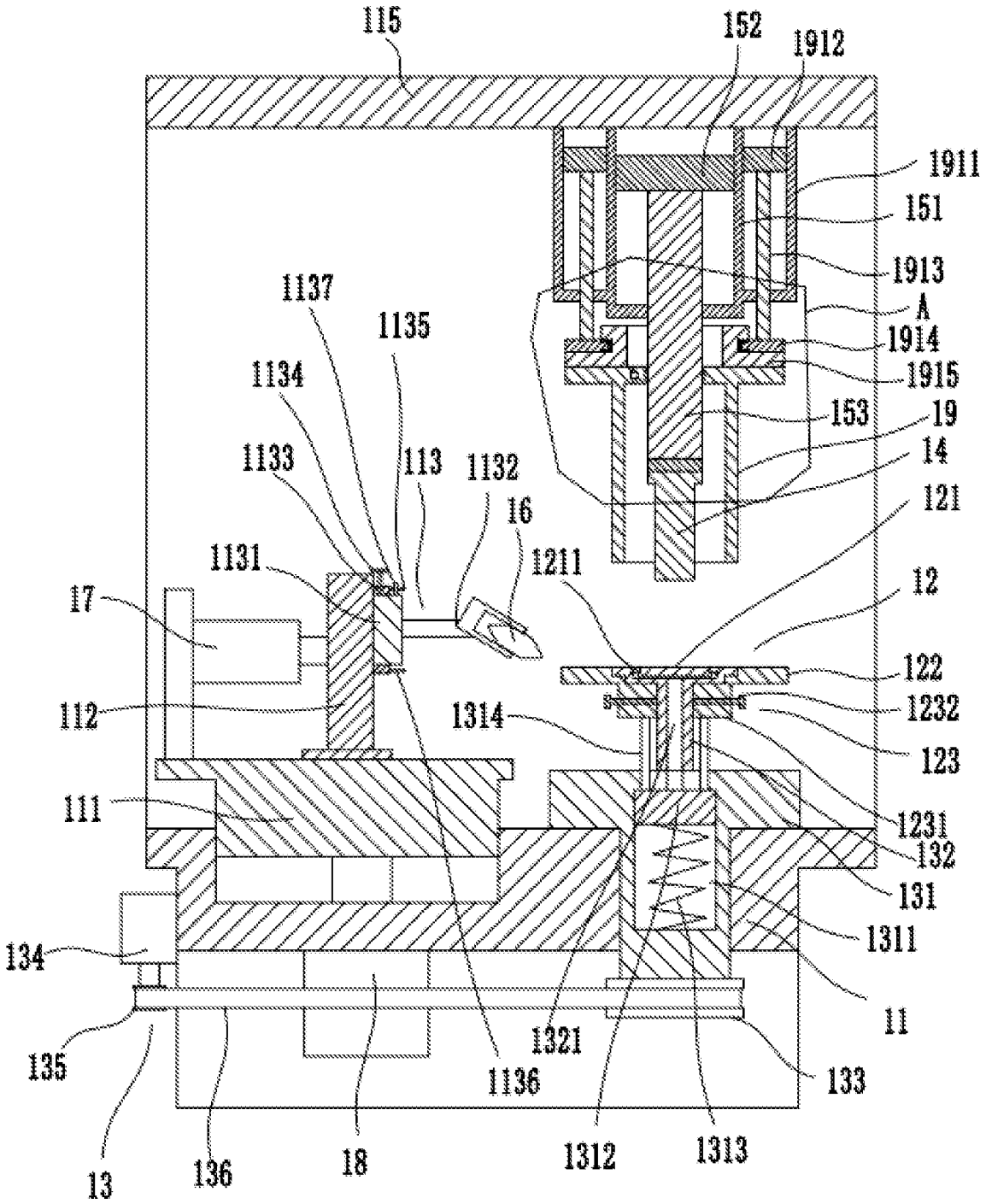
FIG. 1 is a schematic diagram of an example splitting spinning apparatus.
Figure 2:
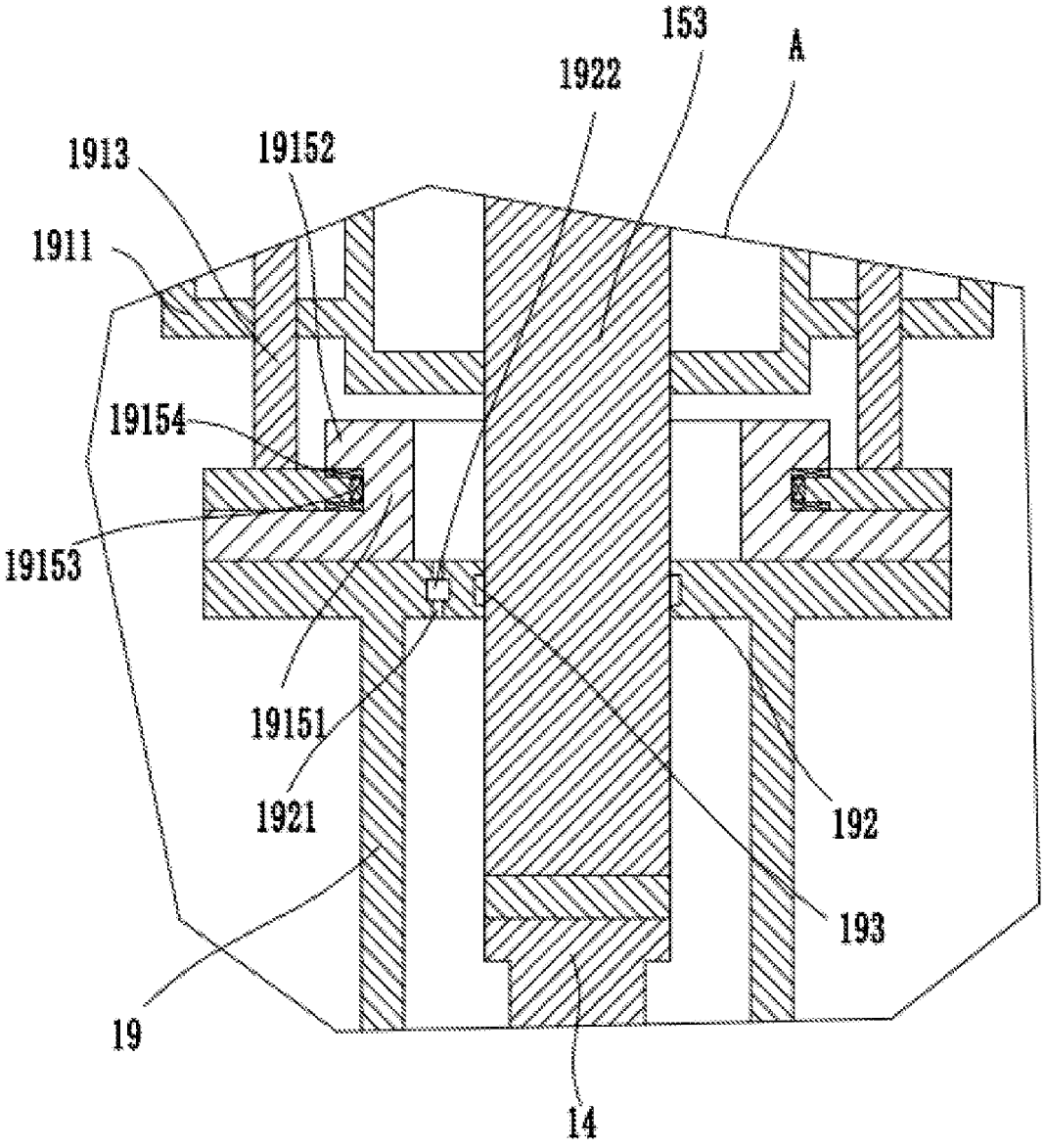
FIG. 2 is an enlarged view of part A in FIG. 1.

Hereinafter, the technical solution of the disclosure will be further explained through embodiments with reference to the accompanying drawings.

Referring to FIGS. 1 through 9, a splitting spinning apparatus comprises a base 11, a turntable 12 for supporting a blank 21, a rotating mechanism 13 for driving the turntable 12, a mandrel 14 disposed above the turntable 12, and a first drive mechanism for driving the mandrel 14 to move along a vertical direction, where a roller 16 is provided at one side of the turntable 12, a second drive mechanism 17 for driving the roller 16 to move along the radial direction of the blank 21 and a third drive mechanism 18 for driving the roller 16 to move along the vertical direction are disposed on the base 11; the splitting spinning apparatus further comprises a squeezing roll 19 disposed above the turntable 12 and a fourth drive mechanism for driving the squeezing roll 19 to move along the vertical direction, where the squeezing roll 19 and the mandrel 14 are coaxially arranged; the turntable 12 comprises an inner plate 121 rotatably connected to the base 11, an outer plate 122 sleeved outside of the inner plate 121 and slidable along the axial direction of the inner plate 121, and a hold mechanism 123 for holding the outer plate 122 in place, where the blank 21 has a diameter greater than that of the inner plate 121 but less than the outer diameter of the outer plate 122, the upper side of the inner plate 121 is in flush with the upper side of the outer plate 122, and the outer diameter of the squeezing roll 19 is equal to the diameter of the inner plate 121.

With the above arrangement, the roller 16 first splitting spins the blank 21 to cause an edge of the blank 21 to be bifurcated into a baseplate 22 and a trumpet flange 23; then, the roller 16 moves upward to spin the trumpet flange 23 to form the inner cylinder; for continuously working the outer cylinder, the outer plate 122 moves downward to expose the lower side of the baseplate 22 to the air; after the squeezing roll 19 compresses the baseplate 22 tightly against the inner plate 121, the roller 16 moves along the radial direction of the blank 21, and then the edge of the baseplate 22 tilts upward under the action of the roller 16, such that after the roller 16 gets close to the squeezing roll 19, the roller 16 moves upward to cause the baseplate 22 to be continuously deformed to form the outer cylinder fitted to the outer wall of the squeezing roll 19.

Figure 3:
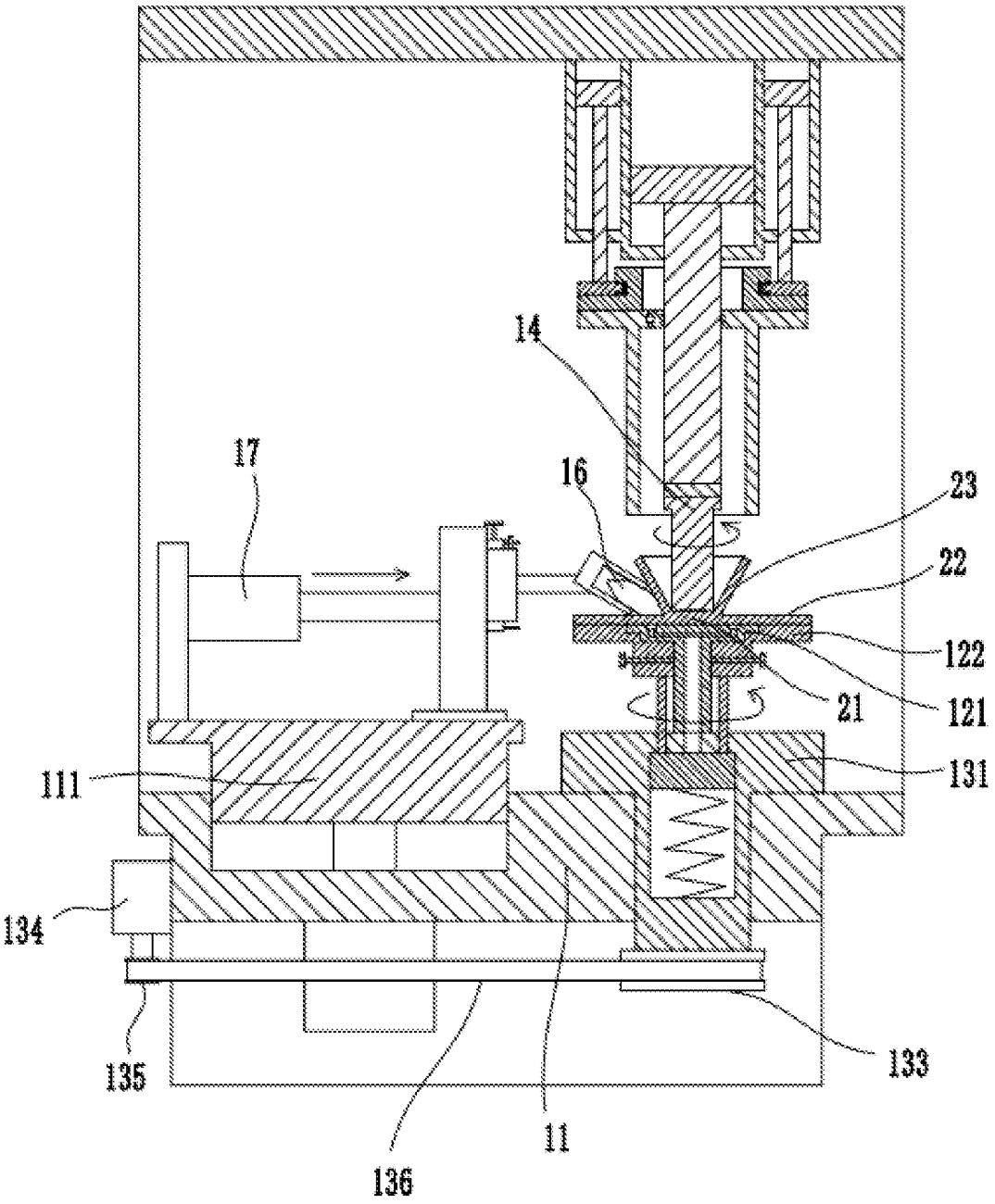
FIG. 3 is a schematic diagram of a roller splitting spinning a blank.
Figure 4:
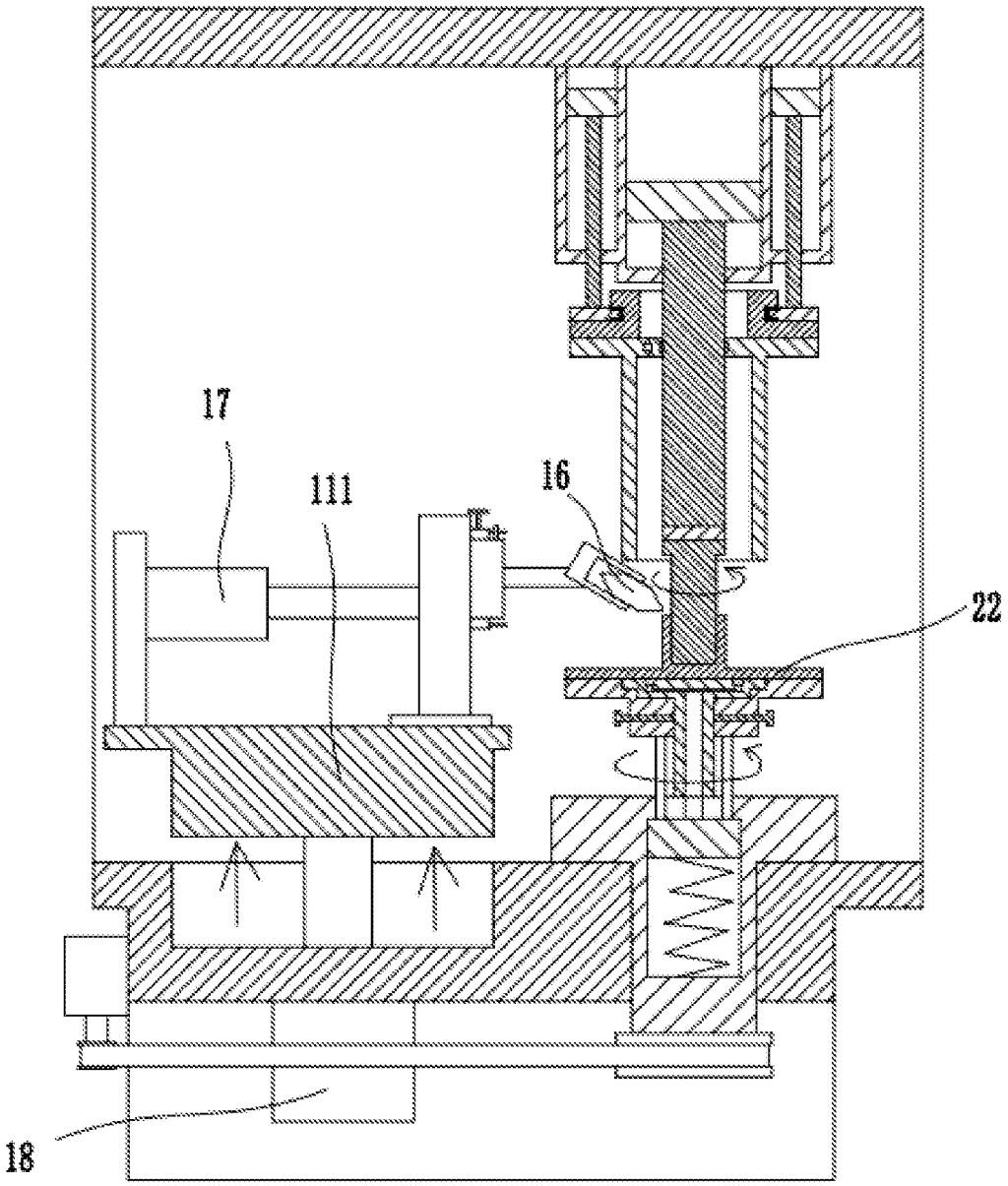
FIG. 4 is a schematic diagram of a roller spinning a trumpet flange to work an inner cylinder.
Figure 5:
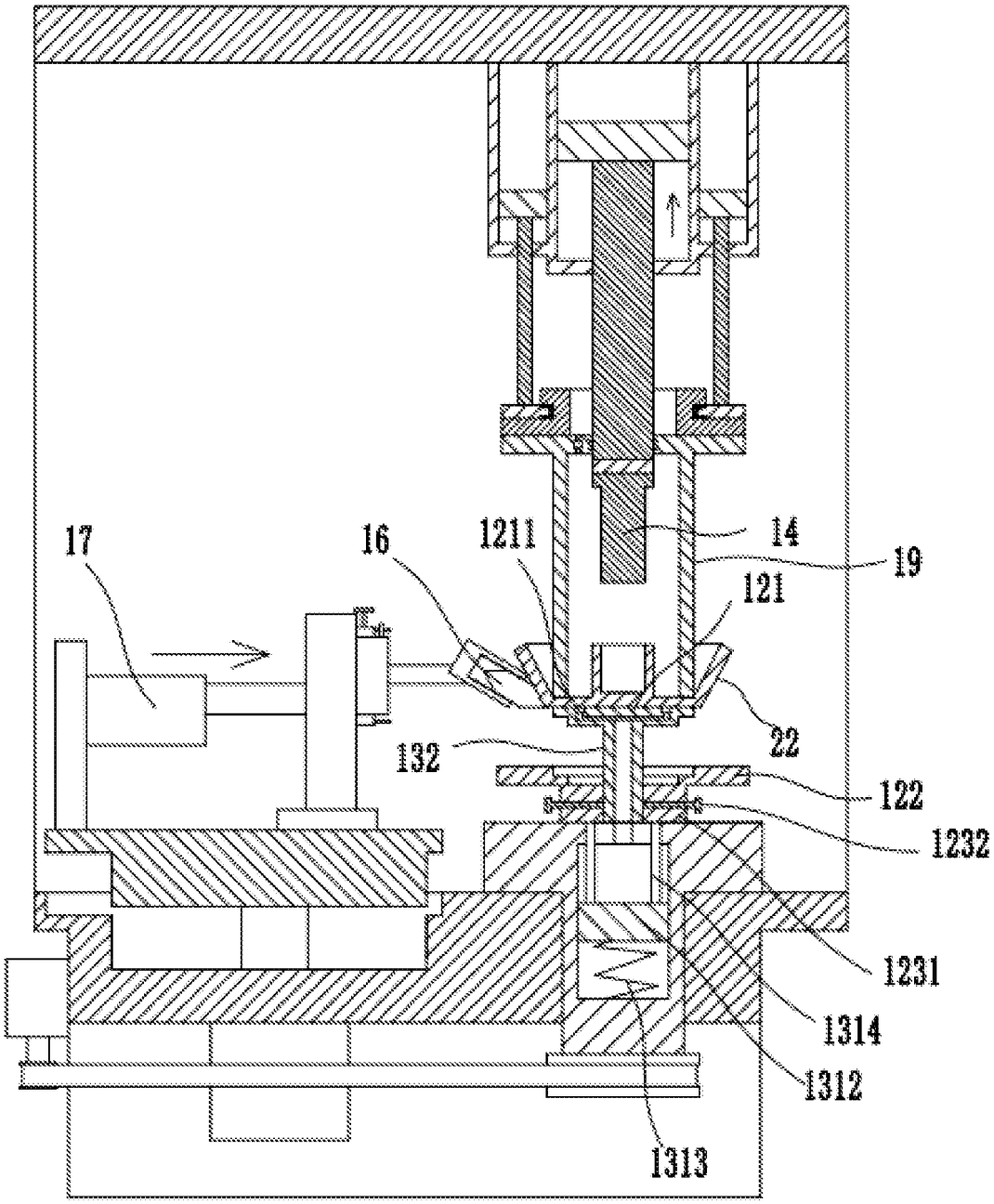
FIG. 5 is a schematic diagram of the roller working a baseplate.
Figure 6:
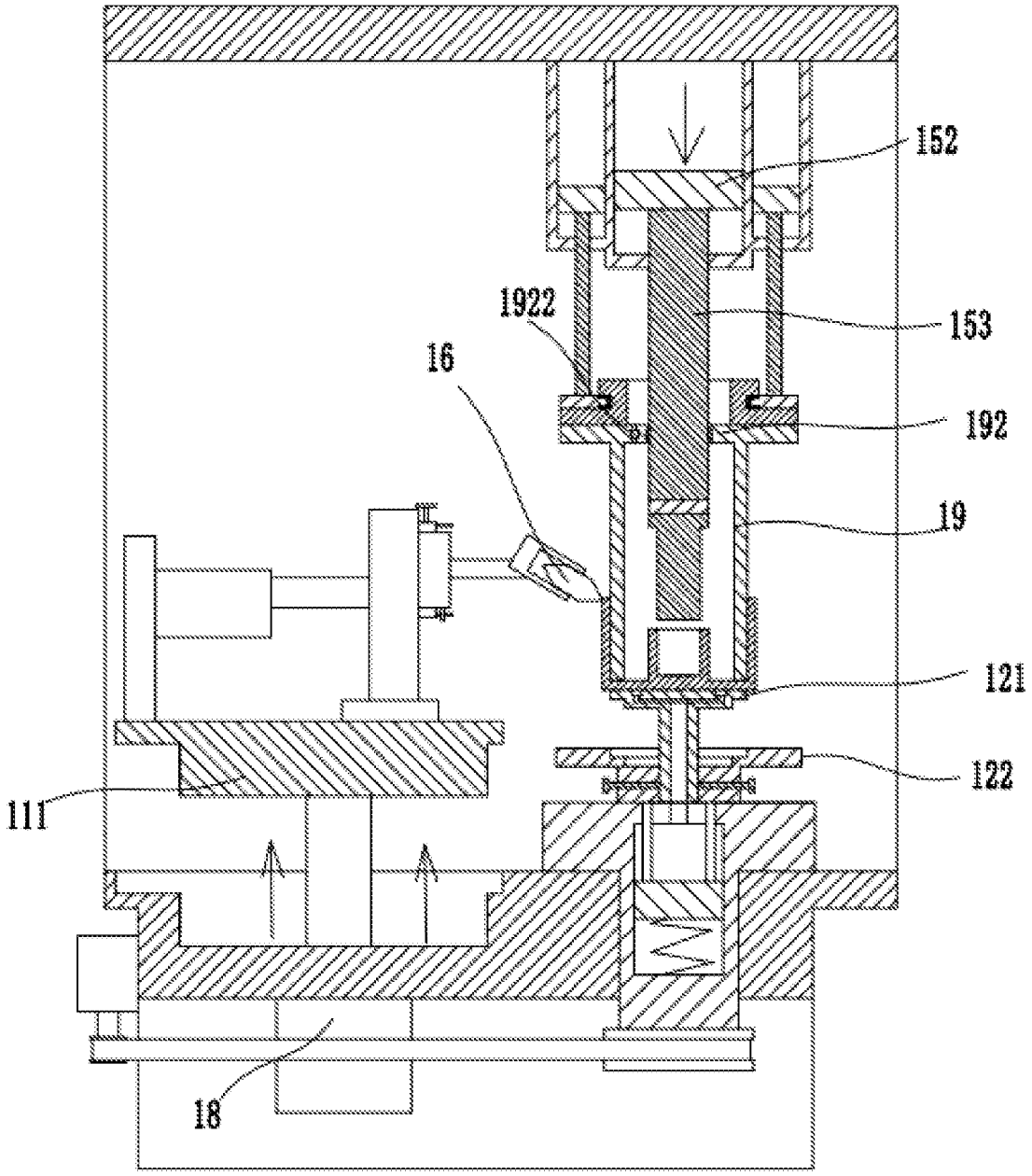
FIG. 6 is a schematic diagram of the roller working an outer cylinder.

Specifically, the roller 16 herein may be a conventional roller. In operation, the inner cylinder is worked before the outer cylinder. When working the inner cylinder, a round blank 21 is first placed on the turntable 12; the first drive mechanism drives the mandrel 14 to move downward to compress the blank 21 tightly against the turntable 12; the inner plate 121 and the outer plate 122 serve to support the blank 21; the rotating mechanism 13 is activated to bring the turntable 12, the blank 21, and the mandrel 14 to rotate synchronously, and the second drive mechanism 17 drives the roller 16 to move towards the mandrel 14 along the radial direction of the blank 21; when the roller 16 engages the edge of the blank 21, the blank 21 brings the roller 16 to rotate; as the roller 16 moves continuously, the end portion of the roller 16 splitting spins the blank 21, causing the edge of the blank 21 to be bifurcated to form the baseplate 22 and the trumpet flange 23, as illustrated in FIG. 3. After the roller 16 gets close to the mandrel 14, the third drive mechanism 18 drives the roller 16 to move upward to spin the trumpet flange 23, whereby the trumpet flange 23 is deformed to form the inner cylinder fitted to the outer side of the mandrel 14, as illustrated in FIG. 4. To work the outer cylinder, the second drive mechanism 17 drives the roller 16 away from the mandrel 14, the hold mechanism 123 releases the outer plate 122 such that the outer plate 122 moves downward to be separated from the baseplate 22, causing the lower side of the baseplate 22 exposed in the air; then, the squeezing roll 19 moves downward to compress the baseplate 22 tightly against the inner plate 121, and the third drive mechanism 18 drives the roller 16 to move downward to cause the lower end of the roller 16 to be lower than the lower side of the baseplate 22; after the rotating mechanism 13 brings the blank 21, the squeezing roll 19, and the turntable 12 to rotate synchronously, the second drive mechanism 17 drives the roller 16 to get close to the baseplate 22; after the roller 16 engages the baseplate 22, the baseplate 22 brings the roller 16 to rotate; as the roller 16 proceeds continuously, the edge of the baseplate 22 tilts upward under the action of the roller 16; when the roller 16 gets close to the squeezing roll 19, the third drive mechanism 18 drives the roller 16 to move upward to spin the deformed baseplate 22 such that the baseplate 22 continues deformed to form an outer cylinder fitted to the outer wall of the squeezing roll 19, as illustrated in FIG. 6.

As an implementation manner, the roller 16 comprises a first state and a second state; when the roller 16 is in the first state, one end of the roller 16 proximal to the turntable 12 tilts downward for the roller 16 to splitting spin the upper side of the blank 21 to form the inner cylinder; when the roller 16 is in the second state, one end of the roller 16 proximal to the turntable 12 tilts upward, such that the roller 16 spins the baseplate 22 to form the outer cylinder.

With the arrangement above, the disclosure eliminates the need of first processing the edge of the baseplate 22 when working the outer cylinder; instead, the roller 16 in the second state moves directly upward to spin the baseplate 22 to form the outer cylinder, whereby the disclosure improves the efficiency of working the outer cylinder. In addition, when the roller in the first state works the blank, the upper side of the roller is worn, while when the roller is switched to the second state, the upper side and the lower side of the roller are reversed, such that when the roller in the second state moves upward to spin the baseplate, the opposite lower side of the roller is worn. In view of the above, by switching the roller' states to produce a cylindrical structure, both of the upper and lower sides of the roller can be worn; as a result, uniform wear of the roller further extends its service life.

Figure 7:
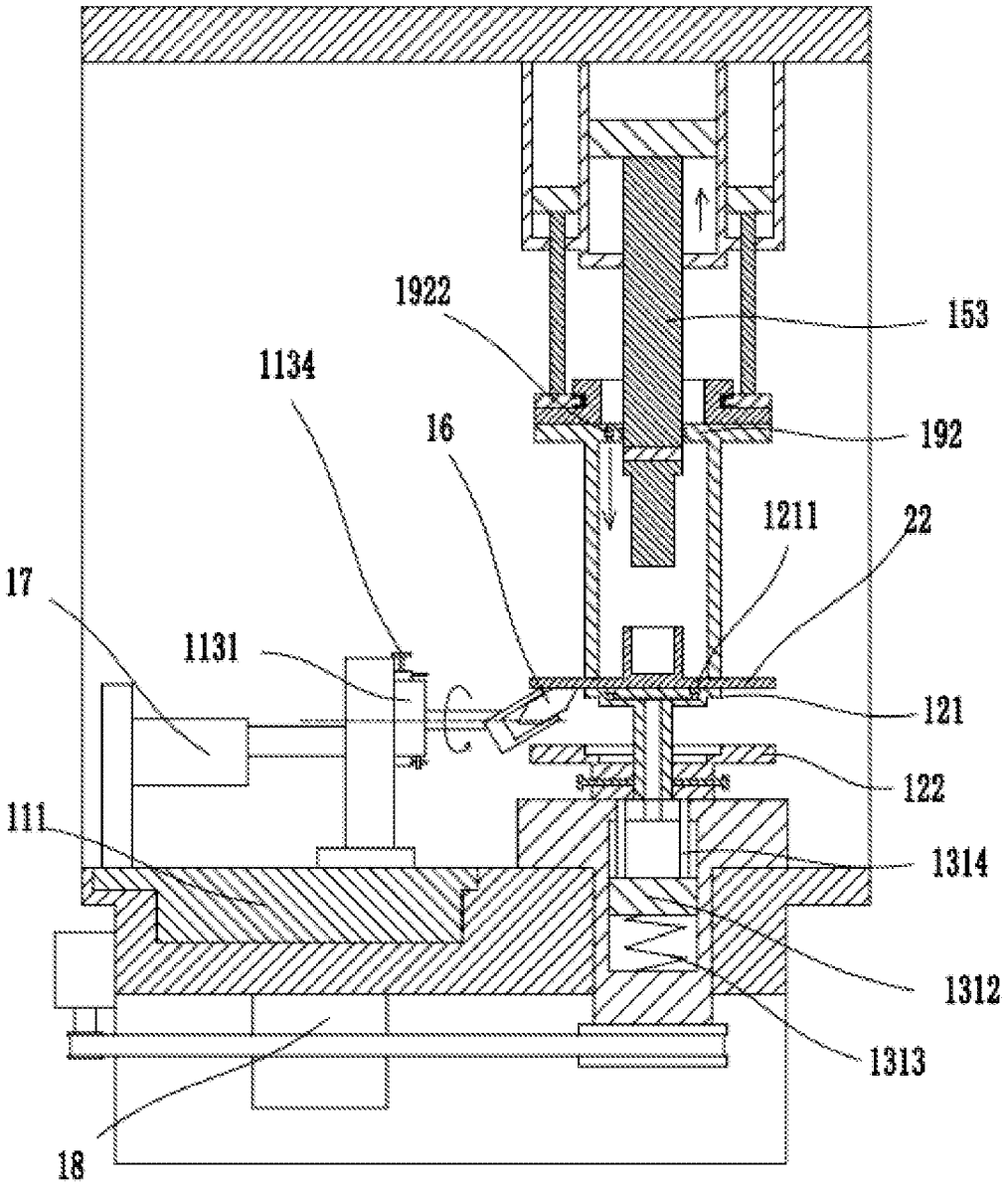
FIG. 7 is a schematic diagram of the roller in a second state moving to the lower side of the baseplate.
Figure 8:
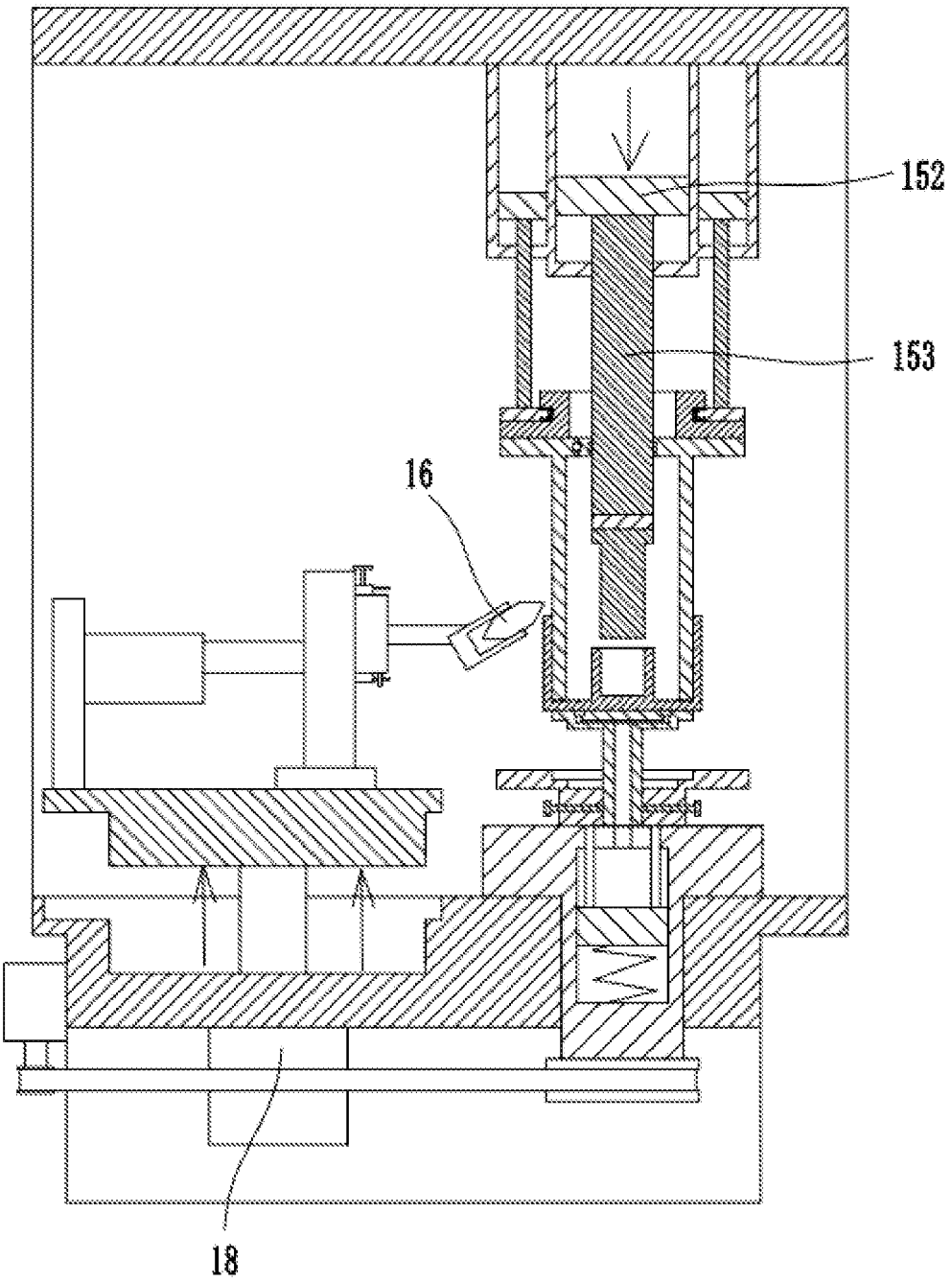
FIG. 8 is a schematic diagram of the roller in the second state working an outer cylinder.

Specifically, when working the inner cylinder, the roller 16 is in the first state, which facilitates the lower end of the roller 16 to splitting spin the blank 21; after the edge of the blank 21 is bifurcated, the trumpet flange 23 extends obliquely upward along the roller 16, as illustrated in FIG. 3. After the roller 16 gets close to the mandrel 14, the roller 16 moves upward to work the inner cylinder, as illustrated in FIG. 4. When the roller in the first state is working the inner cylinder, the upper side of the roller is worn. To work the outer cylinder, after the outer plate 122 moves downward and the squeezing roll 19 compresses tightly the baseplate 22, the roller 16 is switched to the second state, where the upper side and lower side of the roller are reversed; the orientation of the roller 16 is adjusted via the second drive mechanism 17 and the third drive mechanism 18, whereby the upper end of the roller 16 comes close to the edge of the inner plate 121, as illustrated in FIG. 7; at this point, after the rotating mechanism 13 drives the blank 21, the turntable 12, and the squeezing roll 19 to rotate synchronously, the third drive mechanism 18 drives the roller 16 to move upward and the roller 16 spins the baseplate 22, causing the baseplate 22 deformed to form the outer cylinder fitted to the outer wall of the squeezing roll 19, as illustrated in FIG. 8. When the roller in the second state moves upward to spin the baseplate, the opposite side of the roller is worn; in view of the above, by switching between the roller's states to work a cylindrical structure, both of the upper and lower sides of the roller can be worn uniformly, which further extends service life of the roller.

As an implementation manner, a lifting platform 111 is disposed at one side of the turntable 12, where the third drive mechanism 18 is disposed on the base 11 and connected to the lifting platform 111; the upper side of the lifting platform 111 is slidably connected to a sliding seat 112, where the second drive mechanism 17 is disposed on the lifting platform 111 and connected to the sliding seat 112; a roller carrier 113 is provided at the side of the sliding seat 112 proximal to the turntable 12, where one end of the roller carrier 113 proximal to the turntable 12 is rotatably connected to the roller 16, and the roller carrier 113 is rotatably connected to the sliding seat 112, facilitating switching between the states of the roller 16 by turning the roller carrier 113. The sliding seat 112 is provided with a locking mechanism for locking the roller carrier 113.

The above arrangement facilitates switching between the states of the roller 16, further enhancing production efficiency of the disclosure.

Specifically, when the third drive mechanism 18 drives the lifting platform 111 to move vertically, the lifting platform 111 brings the sliding seat 112, the roller carrier 113, and the roller 16 to move upward; when the second drive mechanism 17 drives the sliding seat 112 to move along the lifting platform 111, the sliding seat 112 brings the roller carrier 113 and the roller 16 to move along the radial direction of the blank 21. After the locking mechanism is unlocked, the roller carrier 113 may rotate about the horizontal axis, where the rotating range of the roller carrier 113 is 180°; the roller carrier 113 brings the roller 16 to rotate, causing the roller 16 to be in the first state or the second state; after the state switching is complete, the roller carrier 113 is locked tightly by the locking mechanism 113. Specifically, the second drive mechanism may be provided as an oil cylinder, while the third drive mechanism 18 may also be provided as an oil cylinder.

As an implementation manner, the roller carrier 113 comprises a rotating seat 1131 rotatably connected to the sliding seat 112 and a bracket 1132 securely connected to the side of the rotating seat 1131 proximal to the turntable 12; the roller 16 is rotatably connected to the end of the bracket 1132 proximal to the turntable 12; the locking mechanism comprises a retaining ring 1133 securely connected to the sliding seat 112 and a locking bolt 1134 thread-fitted to the retaining ring 1133, where the rotating seat 1131 is rotatably connected inside the retaining ring 1133, and the locking bolt 1134 abuts against the rotating seat 1131.

The arrangement above facilitates locking of the roller carrier 113.

Specifically, the rotating seat 1131 has a cylindrical shape; the axial line of the rotating seat 1131 extends along the horizontal direction; the retaining ring 1133 enables the rotating seat 1131 to rotate more stably; when the locking bolt 1134 is unscrewed, the locking bolt 1134 is disengaged from the rotating seat 1131, and the rotating seat 1131 may rotate about the axial line of the rotating seat 1131, thereby switching between the states of the roller 16; after the switching is complete, the locking bolt 1134 is screwed tightly, whereby the rotating seat 1131 may be locked tightly.

As an implementation manner, a first limiting rod 1135 is securely connected to the upper side of the retaining ring 1133, a second limiting rod 1136 is securely connected to the lower side of the retaining ring 1133, and a rotating rod 1137 is securely connected to the rotating seat 1131, where when the rotating rod 1137 abuts against the first limiting rod 1135, the roller 16 is disposed in the first state; when the rotating rod 1137 abuts against the second limiting rod 1136, the roller 16 is disposed in the second state.

With the arrangement above, positioning of the roller carrier 113 is facilitated when the roller 16 is switched between the states by turning the roller carrier 113.

As an implementation manner, a top plate 115 is disposed above the base 11, the top plate 115 is securely connected to the base 11 via the connecting plate, and the first drive mechanism is configured as a first oil cylinder, where the first oil cylinder comprises a first cylinder body 151 securely connected to the lower side of the top plate 115, a first piston 152 slidably connected inside the first cylinder body 151, a first piston rod 153 securely connected to the lower side of the first piston 152, and a first oil pump connected to the first cylinder body 151, where the lower end of the first piston rod 153 is rotatably connected to the squeezing roll 19.

The first oil cylinder is fully filled with oil; when the first oil pump delivers the oil to the upper end of the oil cylinder, the pressure at the upper side of the first piston 152 increases, causing the oil at the lower side of the first piston 152 to be discharged from the first oil cylinder, whereby the first piston 152 brings the first piston rod 153 and the mandrel 14 to move downward; likewise, when the first oil pump delivers the oil to the lower end of the first oil cylinder, the pressure at the lower side of the first piston 152 increases, causing the oil at the upper side of the first piston 152 to be discharged from the first oil cylinder, whereby the first piston 152 brings the first piston rod 153 and the mandrel 14 to move upward.

As an implementation manner, the fourth drive mechanism comprises a shell 1911 sleeved over the first cylinder body 151, and a first cavity surrounding the first cylinder body 151 is formed between the shell 1911 and the first cylinder body 151; the fourth drive mechanism further comprises a second piston 1912 slidingly connected inside the first cavity, a second piston rod 1913 securely connected to the lower side of the second piston 1912, and a second oil pump in communication with the first cavity, where a mounting plate 1914 is securely connected to the lower end of the second piston rod 1913 and the squeezing roll 19 is rotatably connected to the lower side of the mounting plate 1914.

The first cavity is fully filled with oil; when the second oil pump delivers the oil to the upper end of the first cavity, the pressure at the upper side of the second piston 1912 increases, causing the oil at the lower side of the second piston 1912 to be discharged from the first cavity, whereby the second piston 1912 brings the second piston rod 1913, the mounting plate 1914, and the squeezing roll 19 to move downward; when the second oil pump delivers the oil to the lower end of the first cavity, the pressure at the lower side of the second piston 1912 increases, causing the oil at the upper side of the second piston 1912 to be discharged from the first cavity, whereby the second piston 1912 brings the second piston rod 1913, the mounting plate 1914, and the squeezing roll 19 to move upward.

As an implementation manner, a rotating plate 1915 is disposed between the mounting plate 1914 and the squeezing roll 19; the rotating plate 1915 and the mounting plate 1914 are both of an annular shape; the first piston rod 153 passes through the rotating plate 1915 and the mounting plate 1914; the rotating plate 1915 and the squeezing roll 19 are detachably connected; a guide ring 19151 extending upward is securely connected to the inner side of the rotating plate 1915; a limiting protrusion 19152 extending outward is securely connected to the upper side of the guide ring 19151; the inner side of the mounting plate 1914 is disposed between the limiting protrusion 19152 and the rotating plate 1915; a rolling bearing 19153 is disposed between the mounting plate 1914 and the guide ring 19151; a thrust bearing 19154 is disposed between the limiting protrusion 19152 and the mounting plate 1914; and the thrust bearing 19154 is also disposed between the mounting plate 1914 and the rotating plate 1915.

The arrangement above increases rotating stability of the squeezing roll 19 and also reduces resistance against rotation of the squeezing roll 19.

Specifically, when the inner side of the mounting plate 1914 is disposed between the limiting protrusion 19152 and the rotating plate 1915, vertical play of the squeezing roll 19 is prevented, where the inner side of the rolling bearing 19153 is fitted to the guide ring 19151 and the external side of the rolling bearing 19153 is fitted to the mounting plate 1914, whereby transverse play of the squeezing roll 19 is prevented.

As an implementation manner, the rotating mechanism 13 comprises an output seat 131 rotatably connected to the base 11, where the inner plate 121 is disposed at the upper side of the output seat 131 and securely connected to the output seat 131 via a connecting post 132; the rotating mechanism 13 further comprises a driven wheel 133 securely coupled to the output seat 131, an electric motor 134 disposed at the lower side of the base 11, and a driving wheel attached to the electric motor 134, where the driving wheel 135 is in transmission connection with the driven wheel 133 via a belt 136, the radius of the driving wheel 135 being smaller than that of the driven wheel 133.

With the arrangement above, the force outputted from the output seat 131 is amplified.

Specifically, the electric motor 134 actuates the turntable 12 to rotate via the driving wheel 135, the belt 136, the driven wheel 133, and the output seat 131. The radius of the driving wheel 135 is smaller than that of the driven wheel 133, whereby the force outputted from the electric motor 134 may be amplified.

As an implementation manner, an endplate 192 is securely attached to the upper end of the squeezing roll 19, the endplate 1915 being detachably connected to the rotating plate 1915; the first piston rod 153 passes through the endplate 192 and is in sealed connection with the endplate 192; an O-shaped ring 193 is disposed between the first piston rod 153 and the endplate 192; a first gas channel 1921 passing through the upper and lower sides of the endplate 192 is provided on the endplate 192; the lower end of the first gas channel 1921 extends till the inner side of the squeezing roll 19; the first gas channel 1921 is provided with a one-way valve 1922 facing the inner side of the squeezing roll 19; the hold mechanism 123 comprises a slide bushing 1231 sleeved over the connecting post 132 and a holding bolt 1232 in threaded connection with the slide bushing 1231, where the holding bolt 1232 abuts against the connecting post 132; a plurality of catching grooves 1211 are provided at the upper side of the inner plate 121; a second gas channel 1321 is provided inside the connecting post 132, the upper end of the second gas channel 1321 communicating with the catching grooves 1211; a second cavity 1311 is provided at the inner side of the output seat 131, a third piston 1312 being slidably attached inside the second cavity 1311, where the third piston 1312 partitions the second cavity 1311 into an upper chamber disposed at the upper side of the third piston 1312 and a lower chamber disposed at a lower side of the third piston 1312, the upper chamber communicating with the second gas channel 1321, the lower chamber communicating with the air; the lower chamber is provided with a spring 1313 exerting an upward force against the third piston 1312; a connecting rod 1314 is securely connected to the upper side of the third piston 1312, and the upper end of the connecting rod 1314 abuts against the slide bushing 1231.

With the above arrangement, after the inner cylinder is completely worked and the squeezing roll 19 compresses the baseplate 22 tightly against the inner plate 121, it is easy to pull the mandrel 14 out of the inner cylinder; to work the outer cylinder, the outer plate 122 moves downward to bring the third piston 1312 to move downward, where the third piston 1312 draws out the air in the catching grooves 1211 such that the catching grooves 1211 securely hold the blank 21; after the outer cylinder is completely worked, the first piston rod 153 moves downward to increase the air pressure in the squeezing roll 19, whereby the squeezing roll 19 is easily pulled out from the outer cylinder, which improves demoulding efficiency of the disclosure.

Figure 9:
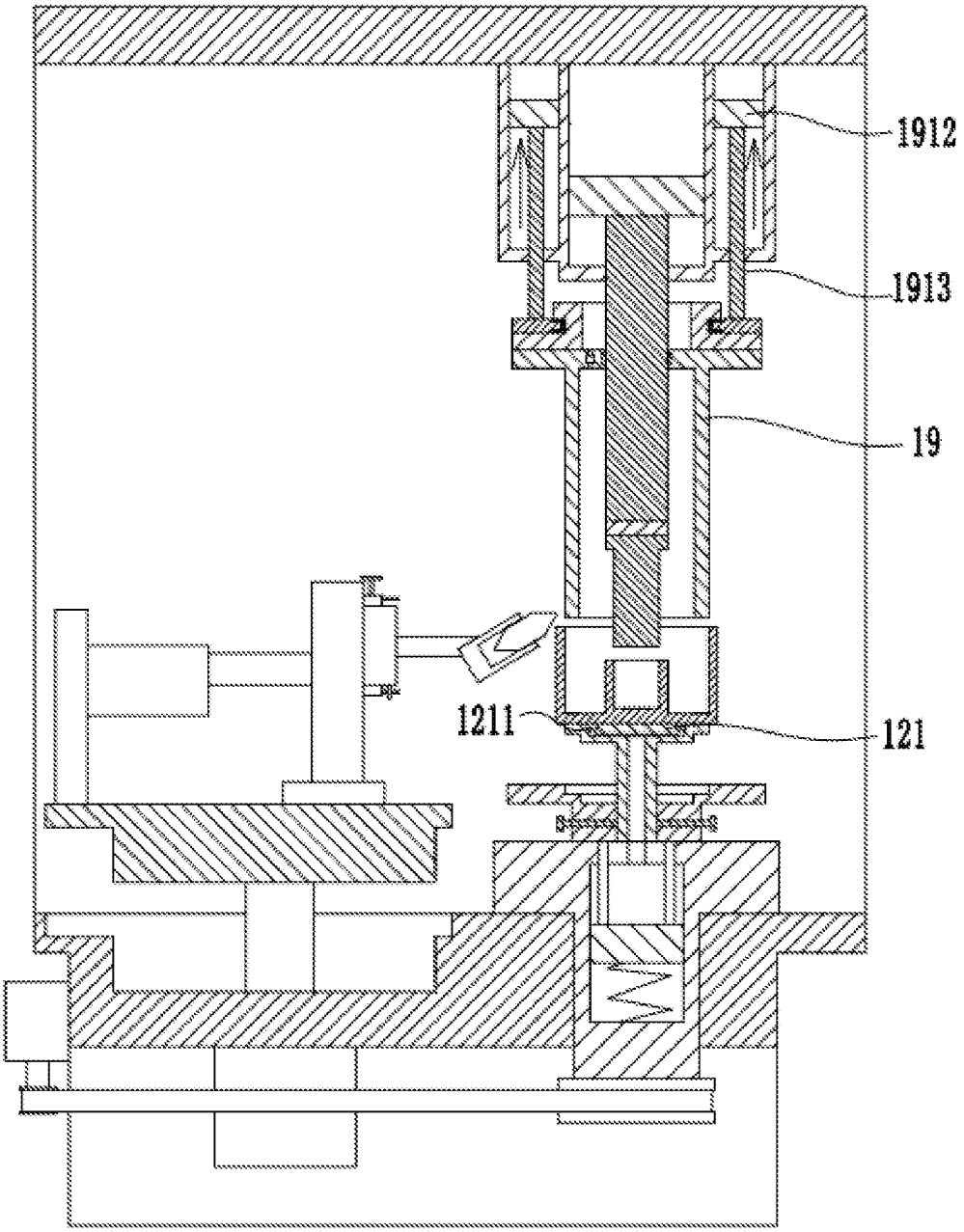
FIG. 9 is a schematic diagram of extracting a squeezing roll from the outer cylinder.

Specifically, after the cylindrical structure is completely worked by the existing splitting spinning apparatus, the demoulding is strenuous since the inner cylinder is compressed tightly against the mandrel 14. In contrast, demoulding is an easy job in the disclosure; as illustrated in FIG. 4, after the roller 16 finishes working of the inner cylinder, it continuously works the outer cylinder, as illustrated in FIG. 7, the squeezing roll 19 first compresses the baseplate 22 tightly against the inner plate 121; at this point, the endplate 192, the squeezing roll 19, the blank 21, and the first piston rod 153 form a sealed cavity; at which time, the first drive mechanism drives the mandrel 14 to move upward, whereby the mandrel 14 is extracted out of the inner cylinder and the ambient air enters the sealed cavity via the first gas channel 1921 and the one-way valve 1922; at this point, the air pressures inside and outside the squeezing roll 19 are substantially consistent; after the holding bolt 1232 is unscrewed, the slide bushing 1231 slides along the connecting post 132 till the lower end of the connecting post 132 and then the holding bolt 1232 is screwed tightly to thereby hold the slide bushing 1231 to the lower end of the connecting post 132; at which time, the outer plate 122 is disposed below the inner plate 121, and under the action of the slide bushing 1231, the connecting rod 1314 and the third piston 1312 move downward to compress the spring 1313; when the third piston 1312 moves downward, the volume of the upper chamber is enlarged due to extraction of the air out of the catching grooves 1211, whereby the cylindrical structure is caught by the catching grooves 1211; after working of the outer cylinder is complete, as illustrated in FIG. 8, the first piston rod 153 moves downward to get close to the inner cylinder, which, on one hand, lowers the height of the mandrel 14 to facilitate next-pass processing, and on the other hand, shrinks the volume inside the sealed cavity and increases the pressure in the sealed cavity such that the air in the sealed cavity exerts a downward force to the cylindrical structure; when the squeezing roll 19 moves upward, it is pulled out from the outer cylinder, and the cylindrical structure is caught to the catching grooves 1211, as illustrated in FIG. 9; finally, the holding bolt 1232 is unscrewed such that the slide bushing 1231 slides upward, causing the upper side of the outer plate 122 to be in flush with the upper side of the inner plate 121; under the action of the spring 1313, the third piston 1312 is reset, and air re-enters the catching grooves 1211, whereby the catching grooves 1211 release the cylindrical structure, it is convenient for the operator to remove the cylindrical structure from the catching grooves 1211.

It is understood that modifications and alternations may be made by those skilled in the art according to the description above, and all such modifications and alternations shall fall within the protection scope of the appended claims.

We claim:

1. A splitting spinning apparatus, comprising a base, a turntable for supporting a blank, a rotating mechanism for driving the turntable, a mandrel disposed above the turntable, a first drive mechanism for driving the mandrel to move along a vertical direction, a roller provided at one side of the turntable, a second drive mechanism for driving the roller to move along a radial direction of the blank, a third drive mechanism for driving the roller to move along the vertical direction and disposed on the base, a squeezing roll disposed above the turntable, and a fourth drive mechanism for driving the squeezing roll to move along the vertical direction, wherein the squeezing roll and the mandrel are coaxially arranged, the turntable comprises an inner plate rotatably connected to the base, an outer plate sleeved outside of the inner plate and slidable along an axial direction of the inner plate, and a hold mechanism for holding the outer plate in place, the blank has a diameter greater than a diameter of the inner plate and less than an outer diameter of the outer plate, an upper side of the inner plate is flush with an upper side of the outer plate, an outer diameter of the squeezing roll is equal to the diameter of the inner plate, the roller comprises a first state and a second state, when the roller is in the first state, one end of the roller proximal to the turntable tilts downward for the roller to splitting spin an upper side of the blank to form an inner cylinder, when the roller is in the second state, one end of the roller proximal to the turntable tilts upward, such that the roller spins a baseplate from the blank to form an outer cylinder, a lifting platform is disposed at one side of the turntable, the third drive mechanism is disposed on the base and connected to the lifting platform, an upper side of the lifting platform is slidably connected to a sliding seat, the second drive mechanism is disposed on the lifting platform and connected to the sliding seat, a roller carrier is provided at one side of the sliding seat proximal to the turntable, one end of the roller carrier proximal to the turntable is rotatably connected to the roller, the roller carrier is rotatably connected to the sliding seat, whereby state switching of the roller is enabled by turning the roller carrier, and the sliding seat is provided with a locking mechanism for locking the roller carrier.

2. The splitting spinning apparatus according to claim 1, wherein the roller carrier comprises a rotating seat rotatably connected to the sliding seat and a bracket securely connected to one side of the rotating seat proximal to the turntable;

the roller is rotatably connected to one end of the bracket proximal to the turntable;

the locking mechanism comprises a retaining ring securely connected to the sliding seat and a locking bolt thread-fitted to the retaining ring, the rotating seat is rotatably connected inside the retaining ring, and the locking bolt abuts against the rotating seat.

3. The splitting spinning apparatus according to claim 2, wherein a first limiting rod is securely connected to an upper side of the retaining ring, a second limiting rod is securely connected to a lower side of the retaining ring, a rotating rod is securely connected to the rotating seat, when the rotating rod abuts against the first limiting rod, the roller is disposed in the first state, and when the rotating rod abuts against the second limiting rod, the roller is disposed in the second state.

4. A splitting spinning apparatus, comprising a base, a turntable for supporting a blank, a rotating mechanism for driving the turntable, a mandrel disposed above the turntable, a first drive mechanism for driving the mandrel to move along a vertical direction, a roller provided at one side of the turntable, a second drive mechanism for driving the roller to move along a radial direction of the blank, a third drive mechanism for driving the roller to move along the vertical direction and disposed on the base, a squeezing roll disposed above the turntable, and a fourth drive mechanism for driving the squeezing roll to move along the vertical direction, wherein the squeezing roll and the mandrel are coaxially arranged, the turntable comprises an inner plate rotatably connected to the base, an outer plate sleeved outside of the inner plate and slidable along an axial direction of the inner plate, and a hold mechanism for holding the outer plate in place, the blank has a diameter greater than a diameter of the inner plate and less than an outer diameter of the outer plate, an upper side of the inner plate is flush with an upper side of the outer plate, an outer diameter of the squeezing roll is equal to the diameter of the inner plate, a top plate is disposed above the base, the top plate being securely connected to the base via a connecting plate, the first drive mechanism is configured as a first oil cylinder, the first oil cylinder comprising a first cylinder body securely connected to a lower side of the top plate, a first piston slidably connected inside the first cylinder body, a first piston rod securely connected to a lower side of the first piston, and a first oil pump connected to the first cylinder body, and a lower end of the first piston rod is rotatably connected to the squeezing roll.

5. The splitting spinning apparatus according to claim 4, wherein the fourth drive mechanism comprises a shell sleeved over the first cylinder body, a first cavity surrounding the first cylinder body is formed between the shell and the first cylinder body, the fourth drive mechanism further comprises a second piston slidingly connected inside the first cavity, a second piston rod securely connected to a lower side of the second piston, and a second oil pump in communication with the first cavity, a mounting plate is securely connected to a lower end of the second piston rod, and the squeezing roll is rotatably connected to a lower side of the mounting plate.

6. The splitting spinning apparatus according to claim 5, wherein a rotating plate is disposed between the mounting plate and the squeezing roll, the rotating plate and the mounting plate are both of an annular shape, the first piston rod passes through the rotating plate and the mounting plate, the rotating plate and the squeezing roll are detachably c a guide ring extends upward and is securely connected to an inner side of the rotating plate, a limiting protrusion extends outward and is securely connected to an upper side of the guide ring, an inner side of the mounting plate is disposed between the limiting protrusion and the rotating plate, a rolling bearing is disposed between the mounting plate and the guide ring, a thrust bearing is disposed between the limiting protrusion and the mounting plate, and the thrust bearing is further disposed between the mounting plate and the rotating plate.

7. The splitting spinning apparatus according to claim 6, wherein the rotating mechanism comprises an output seat rotatably connected to the base, the inner plate is disposed at an upper side of the output seat and securely connected to the output seat via a connecting post, the rotating mechanism further comprises a driven wheel securely coupled to the output seat, an electric motor disposed a lower side of the base, and a driving wheel attached to the electric motor, the driving wheel is in transmission connection with the driven wheel via a belt, and a radius of the driving wheel is smaller than a radius of the driven wheel.

8. The splitting spinning apparatus according to claim 7, wherein an endplate is securely attached to an upper end of the squeezing roll, the endplate is detachably connected to the rotating plate, the first piston rod passes through the endplate and is in sealed connection with the endplate, an O-shaped ring is disposed between the first piston rod and the endplate, a first gas channel passing through upper and lower sides of the endplate is provided on the endplate, a lower end of the first gas channel extends until an inner side of the squeezing roll, the first gas channel is provided with a one-way valve facing the inner side of the squeezing roll, the hold mechanism comprises a slide bushing sleeved over the connecting post and a holding bolt in threaded connection with the slide bushing, the holding bolt abuts against the connecting post, a plurality of catching grooves are provided at an upper side of the inner plate, a second gas channel is provided inside the connecting post, an upper end of the second gas channel communicates with the catching grooves, a second cavity is provided at an inner side of the output seat, a third piston is slidably attached inside the second cavity, the third piston partitions the second cavity into an upper chamber disposed at an upper side of the third piston and a lower chamber disposed at a lower side of the third piston, the upper chamber communicates with the second gas channel, the lower chamber communicates with air, the lower chamber is provided with a spring exerting an upward force against the third piston, a connecting rod is securely connected to an upper side of the third piston, and an upper end of the connecting rod abuts against the slide bushing.

* * * * *